United States Patent [19]

Tanaka et al.

[11] 4,397,328

[45] Aug. 9, 1983

[54] CLEANING APPARATUS OF TUBULAR MATERIALS FOR USE IN PICKLING FACILITIES FOR THE SAME

[75] Inventors: Yoshiro Tanaka; Hayato Moroi; Yukihiko Kamatsu; Kazuo Akagi; Ryujiro Shitamatsu, all of Shimonoseki; Tadashi Nishimura, Yokohama, all of Japan

[73] Assignee: Kabushiki Kaisha Kobe Seiko Sho, Kobe, Japan

[21] Appl. No.: 308,823

[22] Filed: Oct. 5, 1981

[30] Foreign Application Priority Data

Aug. 12, 1981 [JP] Japan ..... 56-120158[U]

[51] Int. Cl.[3] ..... B08B 3/02

[52] U.S. Cl. ..... 134/76; 134/126; 134/152

[58] Field of Search ..... 134/76–77, 134/83, 125–126, 133–134, 152, 170

[56] References Cited

U.S. PATENT DOCUMENTS

| | | | |
|---|---|---|---|
| Re. 28,174 | 9/1974 | Sabatka et al. | 134/125 X |
| 545,429 | 8/1895 | Lewis | 134/133 X |
| 3,074,417 | 1/1963 | Lisowski et al. | 134/76 |

FOREIGN PATENT DOCUMENTS

| | | | |
|---|---|---|---|
| 941004 | 11/1963 | United Kingdom | 134/76 |

*Primary Examiner*—Robert L. Bleutge

*Attorney, Agent, or Firm*—Oblon, Fisher, Spivak, McClelland & Maier

[57] ABSTRACT

A cleaning apparatus for use in pickling facilities for tubular members such as zirconium or zirconium alloy tubes. The apparatus includes a travelling crane for conveying and loading the tubular members from one cleaning tank to another, a pair of endless wrapping connectors such as endless chains spacedly and circulatably provided in at least one tank, for example, in a first cleaning tank filled with slightly warm water below the level of its cleaning fluid, and a plurality of feed claws provided with an interval therebetween on each of the endless wrapping connectors along the length of the same so as to prevent the tubular members from contacting one another during cleaning treatment. Thus, development of stain or physical damage such as scratches or dents is eliminated or minimized. It is possible to tentatively stock the tubular members on the endless wrapping connectors so as to perform a smooth and continuous pickling and cleaning operation of such tubular members.

8 Claims, 22 Drawing Figures

CLEANING APPARATUS OF TUBULAR MATERIALS FOR USE IN PICKLING FACILITIES FOR THE SAME

BACKGROUND OF THE INVENTION

1. Field of the Invention

This invention relates to a cleaning apparatus of tubular members for use in pickling facilities for the same, and more particularly, to an apparatus for cleaning tubular members such as zirconium or zirconium alloy tubes while avoiding their mutual contact to prevent occurrence of stain or physical damages such as scratches or dents thereon.

2. Description of the Prior Art

It has been known that tubular metallic products made of zirconium or its alloy as cladding tubes for nuclear fuel are subjected to a pickling treatment at each of the inner and outer walls thereof as well as, after the pickling treatment, to a cleaning treatment in a slightly warm water tank, high-temperature water tank, alkaline water tank and purified water tank and finally to drying since the surfaces of such products require a strict quality control and must be mirror-finished.

In such a cleaning treatment as mentioned above, if tubular members are caused to contact one another, particularly, when immersing in the slightly warm water tank tubular materials which have been pickled and fed from an unplugging machine, such contact would become a cause of stain or physical damages such as scratches or dents to be developed there, thereby to render the important pickling treatment meaningless.

SUMMARY OF THE INVENTION

With the foregoing in view, the present inventors have carried out an extensive research which has resulted in the completion of the present invention. Accordingly, the principal object of this invention is to provide an apparatus for cleaning tubular members, which have been subjected to a pickling treatment, through their immersion into a tank containing a cleaning liquid while avoiding their mutual contact so as to prevent the occurrence of stain or damages such as scratches or dents and, at the same time, allowing the tank to serve as a stock spot for the tubular members.

In one aspect of this invention, there is thus provided a cleaning apparatus of tubular members for use in pickling facilities for the same, the cleaning apparatus being adapted to clean the tubular members, which have been pickled, by sucessively immersing the same into a plurality of tanks each filled with a cleaning fluid. The apparatus includes a travelling crane for conveying and loading the tubular members from one tank to another, a pair of endless wrapping connectors provided spacedly and circulatably in at least one tank below the level of its cleaning fluid for conveying the tubular materials therethrough while supporting the same below the level of its cleaning fluid, and a plurality of feed claws provided with a predetermined interval on each of the endless wrapping connectors along the length of the same so as to prevent the tubular members from contacting to one another.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
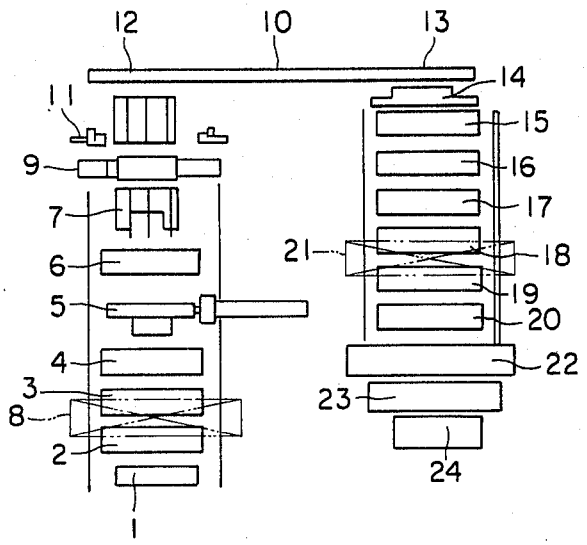
FIG. 1 is a plan view showing the overall arrangement of pickling facilities for tubular members.
Figure 2:
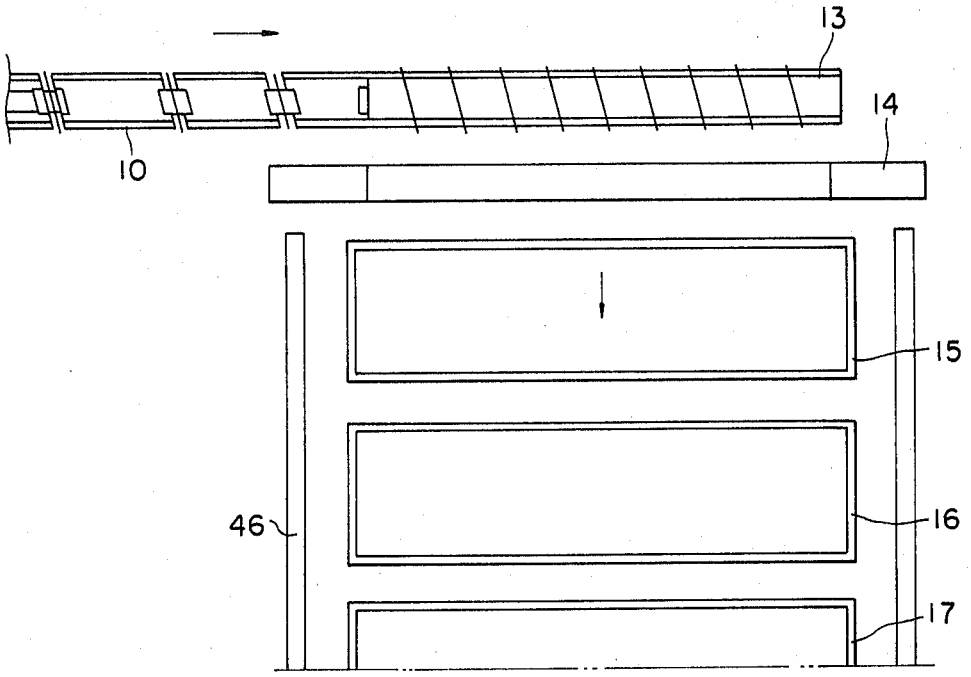
FIG. 2 is a plan view illustrating a tube exterior pickling apparatus and its subsequent cleaning tanks.
Figure 3:
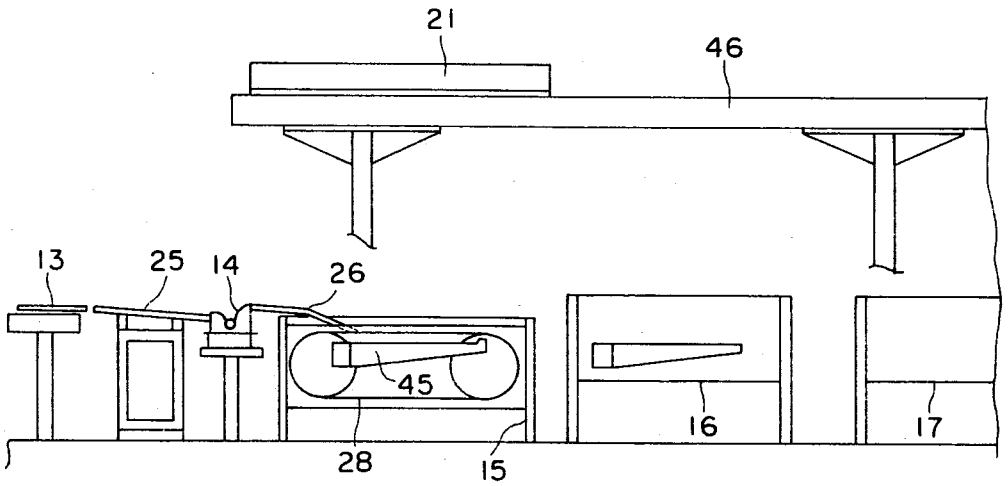
FIG. 3 is a side elevational view of the apparatus and tanks depicted in FIG. 2.

FIG. 1 illustrates in plan the overall arrangement of pickling facilities. Tubular members are conveyed successively through a stock table 1, high-temperature water tank 2, degreasing tanks 3, 4, tube interior cleaning apparatus 5, high-temperature water tank 6, and stock table 7 by means of a portal travelling crane 8 which reciprocatingly moves over these tanks, apparatus and tables. The inner walls of the tubular members are then pickled in a tube interior pickling apparatus 9.

Numeral 10 indicates a tube exterior pickling apparatus. Plugs are applied to both ends of tubular members, which have previously been treated in the tube interior pickling apparatus 9, by a plugging machine 11. They are thereafter fed into the tube exterior pickling apparatus 10 through a mechanism for rotating and conveying them such as skew rollers or the like, where their outer surfaces are subjected to a pickling treatment. Then, the thus-pickled tubular members are fed to a cleaning apparatus of the present invention which includes a slightly warm water tank 15 and its subsequent facilities. In the course of the conveyance to the cleaning apparatus, the plugs are pulled out by means of an unplugging machine 14.

In the cleaning apparatus are provided successively in a row the slightly warm water tank 15, rack assembly tank 16, an alkaline water tank 17, a shower tank 18, a high-temperature purified water tank 19 and a low-temperature purified water tank 20 as well as a portable travelling crane 21 capable of moving over these tanks. Designated by numerals 22, 23 and 24 are, respectively, a draying oven, a discharge table and a stock table.

Referring to FIG. 2 through FIG. 9, the discharge conveyor 13 and unplugging machine 14 are connected through an inclined conveyor member 25 while the unplugging machine 14 and the slightly warm water tank 15 are coupled via a chute 26. The chute 26 is provided with a counting device (not shown) for counting the number of tubular members to be charged into the slightly warm water tank 15 therethrough.

The slightly warm water tank 15 is capable of storing therein municipal water of about 25°-30° C. The water may be drained through a drain pipe 27. In tank 15 are provided a pair of endless wrapping connectors below the level of the slightly warm water.

Figure 7:
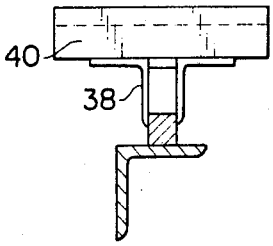
FIG. 7 is an enlarged detail frontal view of a feed claw for tubular materials.
Figure 8:
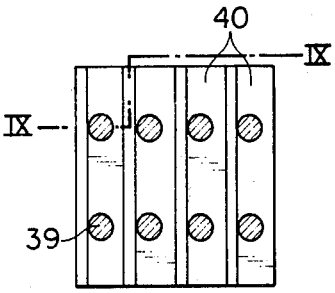
FIG. 8 is a plan view of the feed claw shown in FIG. 7.
Figure 9:
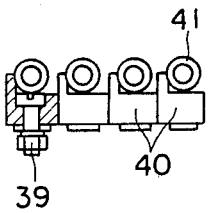
FIG. 9 is a partially cross-sectional view taken along line IX—IX of FIG. 8.

In FIG. 4 through FIG. 9, numeral 29 indicates a motor which is interlocked through a speed reducer, coupling, etc. with a drive shaft 33 extending through the tank 15 and supported by bearings 32. Sprockets 34 are fixedly secured on the drive shaft 33 with an axial interval. Corresponding to the sprockets 34 are provided driven sprockets 37 on their respective brackets 36 movably fixed by tension devices 35. Between the sprockets 34 and their corresponding driven sprockets 37, endless chains 38 are extended. Each of the chains 38 is provided, as shown in FIG. 7 through FIG. 9, with a row of feed claws for tubular members with a predetermined interval by means of screws 39.

Thus, the pair of endless wrapping connectors 28 circulate in a direction perpendicular to the lengthwise direction of the tubular member 41 and are capable of supportingly conveying the tubular member 41 in a state spaced from other tubular members owing to the provision of the feed claws 40.

Furthermore, between the endless wrapping connectors 28, there is circulatably provided an intermediate plain belt device 42 so as to support the tubular member 41 at the midpoint thereof. In addition, to prevent each of the chains 38 from getting loose, a slack prevention board is provided via vertically displaceable and fixable support legs of an incorporated structure.

Between both sides of the intermediate plain belt device 42 and the endless wrapping connectors 28,28, hooks 45 of the travelling crane 21 are allowed to vertically displaceably and horizontally turnably extend, thereby conveying tubular members 41, which have been subjected to a prescribed cleaning treatment while being supported on the endless wrapping connectors 28, to the next rack assembly tank 16. The travelling crane is constructued as shown in FIG. 10 to FIG. 13.

Figure 10:
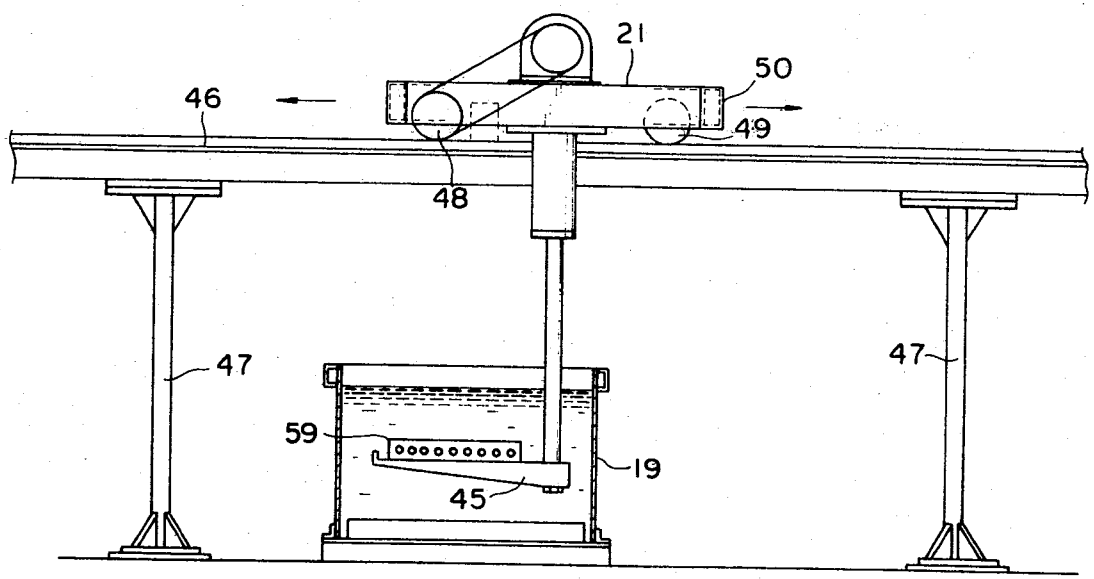
FIG. 10 is a schematic front illustration of a travelling crane used prior to pickling.
Figure 11:
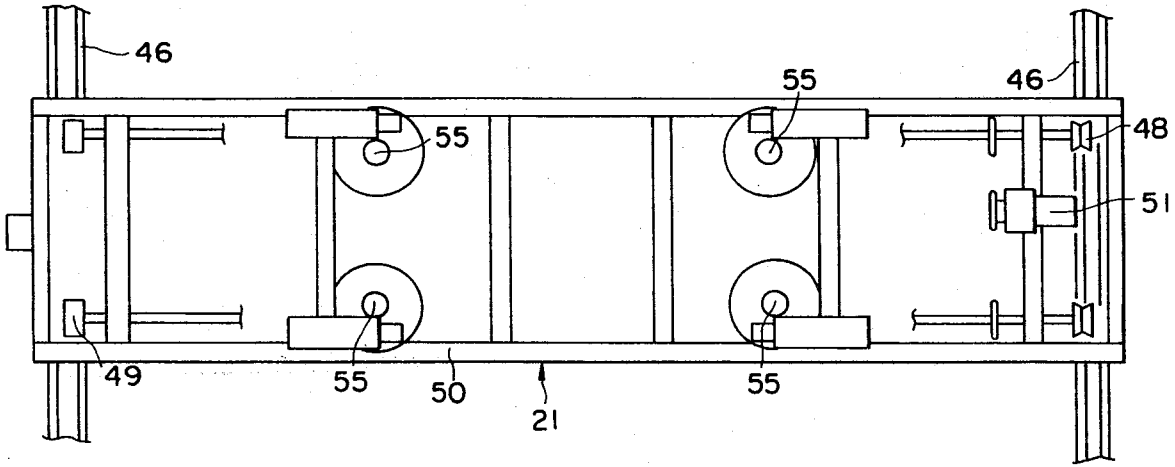
FIG. 11 is a plan view of another travelling crane used after pickling.
Figure 12:
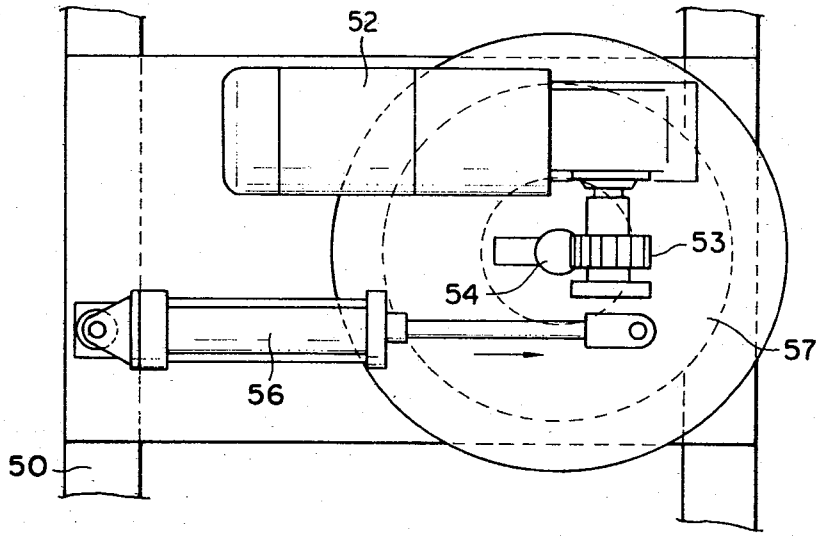
FIG. 12 is an enlarged plan view of a swivel portion of the travelling crane shown in FIG. 11.
Figure 13:
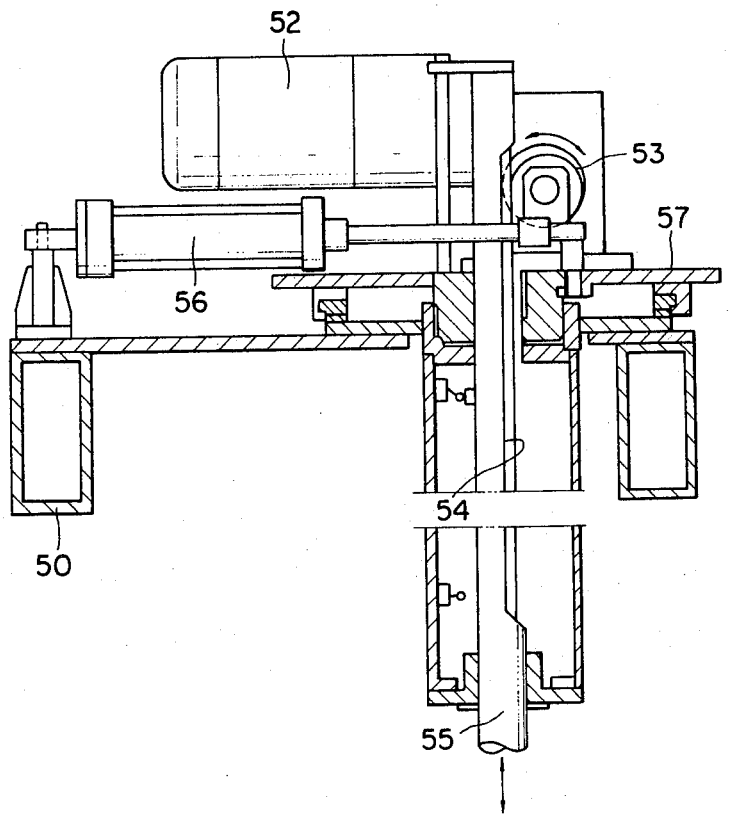
FIG. 13 is a partially cross-sectional view of the swivel portion.

In FIG. 10 through FIG. 13, numerals 46,46 indicate elevated guide rails which extend on posts, respectively, along both sides of the cleaning tanks. A car 50 having a drive wheel 48 and a driven wheel 49 can reciprocatingly travel on the rails 46 through normal or reverse drive of a motor 51. Although FIG. 10 shows the crane 8, FIG. 11 illustrates the travelling crane 21 which features four hooks 45.

Figure 4:
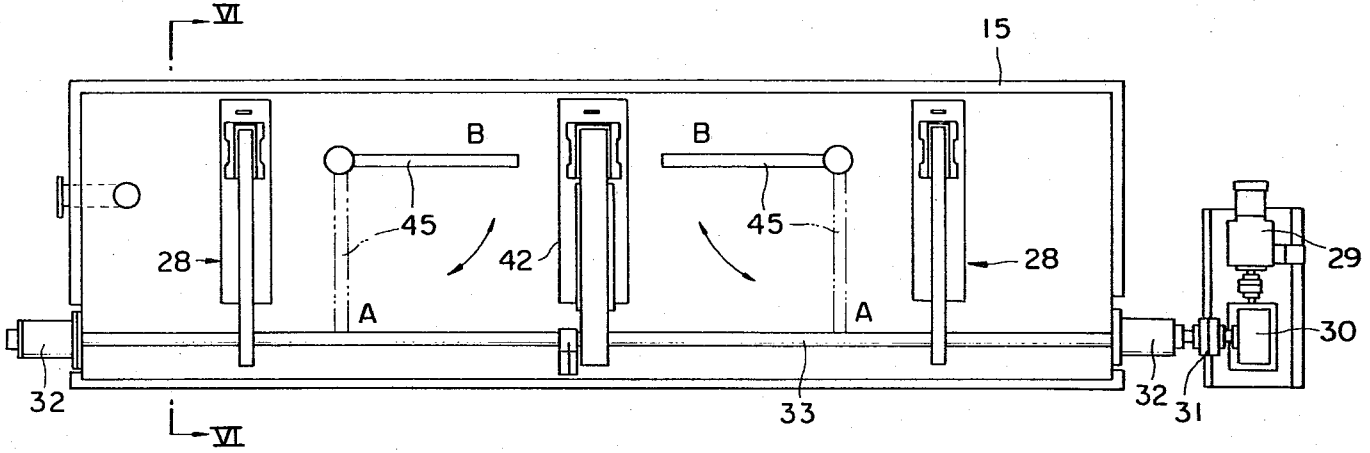
FIG. 4 is a plan view of a slightly warm water tank.
Figure 5:
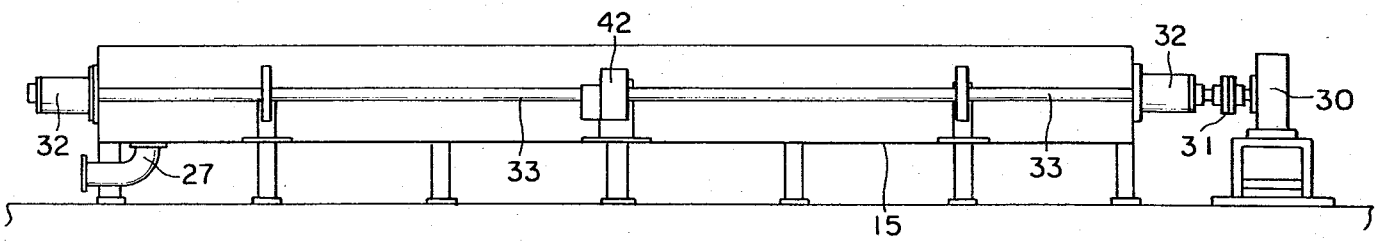
FIG. 5 is a front elevational view of the tank illustrated in FIG. 4.
Figure 6:
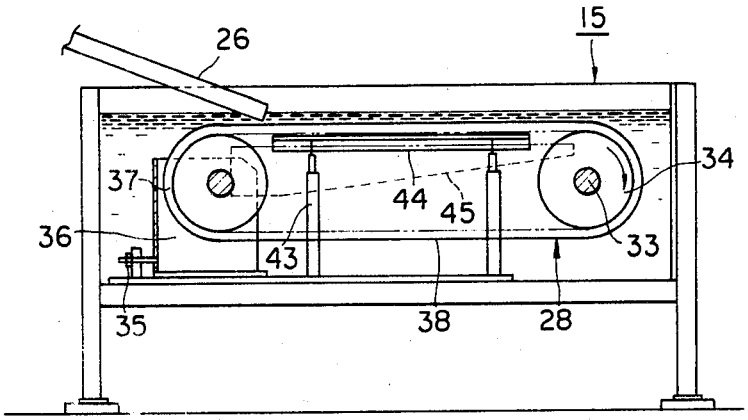
FIG. 6 is a cross-sectional view taken along line VI—VI of FIG. 4.

Car 50 is provided, in the illustrated embodiment, with four hook-supporting rods 55 which are arranged diagonally and are displaceable up and down by the drive power of their corresponding motors 52 through the engagement of their respective pinions 53 and racks 54. By swivelling each turn table 57 through the expansion of a expansion cylinder 56, each of the aforementioned hooks 45 can be displaced between the position A and position B as shown in FIG. 4.

Figure 16:
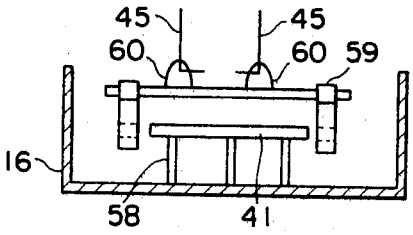
FIGS. 16 and 17 are schematic cross-sectional view of a rack assembly tank showing the rack assembly operation.
Figure 17:
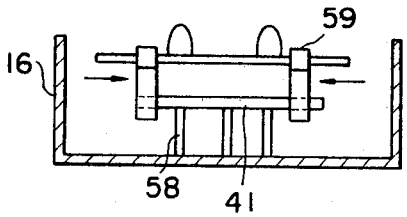

The tubular members 41 are conveyed from the slightly warm water tank 15 and loaded in the rack assembly tank 16 by means of the travelling crane 21. As depicted in FIG. 16 and FIG. 17, the rack assembly tank 16 is provided with a support 58 for tubular members. Thus, owing to the support 58, the tubular members 41 can be assembled in a rack 59 while being supported thereon.

Namely, rack 59 includes a bar frame 61 equipped with hook-engagement members 60 as well as a pair of chuck blocks 62 provided at both ends of the bar frame 61. Each of the blocks 62 defines a number of tube-supporting holes 63 therethrough and is capable of sliding along the bar frame 61.

Therefore, in order to assemble the tubular members 41 in the rack 59, the hooks 45 of the travelling crane 21 are brought into engagement with their corresponding hook-engagement members 60 as shown in FIG. 16. Then, the bar frame 61 together with the chuck blocks 62 is lowered in such a manner that the chuck blocks 62 are astride the tubular members 41 supported on the support 58 until the tube-supporting holes 63 confront their respective tubular members 41. As depicted in FIG. 17, the chuck blocks 62 are displaced by means of a cylinder (not shown) or like mechanism toward each other so as to cause both ends of the tubular members 41 to extend through their corresponding holes 63, thereby assembling the number of tubular members 41 in a mutually spaced state. The thus-assembled tube unit is illustrated in FIG. 18.

Figure 18:
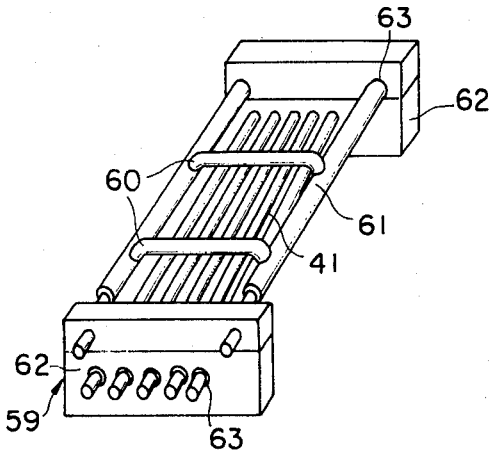
FIG. 18 is perspective view of a rack assembly.
Figure 19:
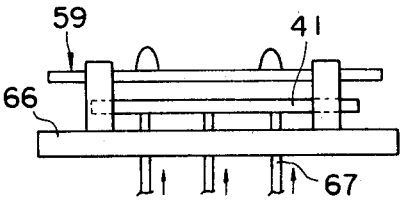
FIGS. 19 through 22 are schematic illustrations of a rack disassembly operation.
Figure 20:
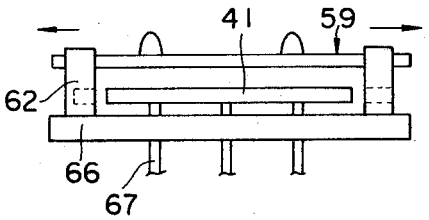

The tubular members 41 assembled into a rack as shown in FIG. 18 are conveyed and loaded into the next alkaline water tank 17 by engaging the hooks 45 of the travelling crane 21 with their corresponding hook-engagement members 60. Thus, the tubular members 41 can be immersed into the alkaline solution (aqueous NaOH solution) of the alkaline water tank 17 while being assembled in the rack, thereby allowing the cleaning treatment to be conducted with the alkaline solution while maintaining the mutually spaced state of the tubular members 41.

Subsequent to the treatment with the alkaline solution, the tubular members 41 are conveyed to and loaded in the next shower tank 18 by means of the crane 21, also while being assembled in the rack.

Figure 15:
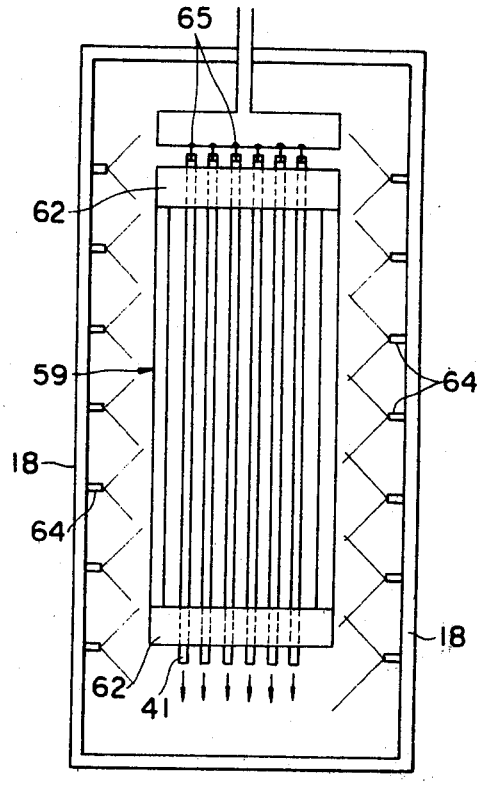
FIG. 15 is a plan view of the shower tank.
Figure 14:
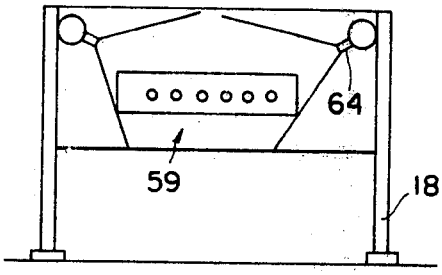
FIG. 14 is a cross-sectional view of a shower tank.

In FIG. 14 and FIG. 15, designated by numeral 64 are shower nozzles for cleaning the outer walls of the tubular members 41. The shower nozzles 64 are provided in the shower tank 18 with a predetermined interval along the lengths of the tubular members 41. On the other hand, interior cleaning nozzles are indicated at numeral 65, which nozzles 65 are located corresponding to the tubular members 41.

Thus, the tubular members 41, which have been assembled in the rack 54, are conveyed to and charged into the shower tank 18 by the travelling crane 21 and cleaned with an alkaline solution jetted out through the exterior cleaning shower nozzles 64 and interior cleaning shower nozzles 65. Thereafter, the tubular members 41, while being still assembled in the rack 54, are immersed into the high-temperature purified water tank 19 and low-temperature purified water tank 20 successively by means of the travelling crane 21 to subject the same to prescribed cleaning treatments. Then, the tubular members 41 travel through the drying oven 22 and discharge table 23 onto the stock table 24.

Figure 21:
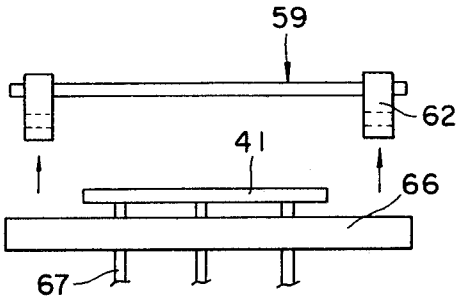
Figure 22:
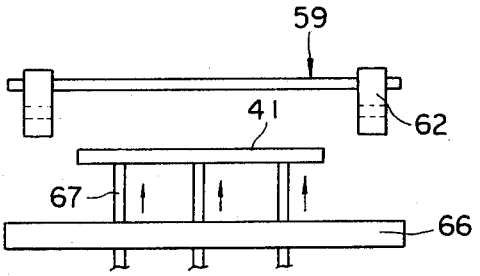

Now, referring to FIG. 19 through FIG. 22, an example of disassembly work of the tubular members 41 from the rack 59 will be described. Numeral 66 indicates a car, on which the rack assembly, i.e., the rack 59 together with the tubular members 41 assembled therein, is supported during their conveyance subsequent to the drying treatment in the drying oven 22. The dried tubular members 41, while still being supported by the rack 59 and also by the car 66, are conveyed onto the discharge table 23 by an unillustrated chain drive mechanism, where a tube-supporting skid 67 attached to the discharge table 23 ascends to support the tubular members 41 thereon. Then, the chuck blocks 62 are moved by an unillustrated cylinder device or the like in directions away from each other so as to separate the chuck blocks 62 from the tubular members 41 (See, FIG. 20). Thereafter, as shown in FIG. 21, the rack 59 is hoisted upwardly by a travelling crane or the like (not shown). Then, skid 67 is raised to push the tubular members 41 upwardly to a position level with the stock table 24 as shown in FIG. 22. Finally, skid 67 is inclined by a cylinder mechanism (not shown) to discharge the tubular members 41 onto the stock table 24.

The cleaning procedure of tubular members after completion of their pickling is carried out as described above. The tubular members 41 fed onto the endless wrapping connectors 28 in the slightly warm water tank 15 through the chute 26 from the unplugging machine 14 can be cleaned in a mutually spaced state owing to the feed claws 40 provided in rows on their respective endless wrapping connectors 28. Therefore, no mutual contact occurs during the cleaning treatment of the tubular members 41, thereby eliminating a cause for the development of stain or physical damage such as scratches or dents. Moreover, the tubular members 41 can be conveyed through the slightly warm water tank 15 at a desired speed. This permits the stocking of the tubular members 41 on the endless wrapping connectors 28, thereby still allowing continuous cleaning operation even if any trouble should occur in the unplugging machine 14 or any subsequent cleaning tank. Furthermore, the provision of the travelling crane 21 over the cleaning tanks has brought about the added advantage that the tubular members 41 can be converyed smoothly from one tank to another and loaded in the latter. The hooks 45 of the travelling crane 21 may be provided with a serrated portion to support the tubular members 41 thereon with an interval, thereby avoiding any mutual contact among the tubular members 41 during their cleaning treatment. This provides another in that it contributes to a further improvement to the quality of the tubular members.

Having now fully described the invention, it will be apparent to one of ordinary skill in the art that many changes and modifications can be made thereto without departing from the spirit or scope of the invention as set forth herein.

What is claimed is:

1. A cleaning apparatus for tubular members for use in pickling facilities for the same, said cleaning apparatus being adapted to clean the tubular members which have been pickled by sucessively immersing the tubular members into a plurality of tanks each filled with a cleaning fluid, said apparatus comprising:

a travelling crane for conveying and loading said tubular members from one tank to another;

a pair of endless wrapping connectors spacedly and circulatably provided in at least one tank below the level of said cleaning fluid for conveying said tubular members while supporting said tubular members below the level of said cleaning fluid; and a plurality of feed claws provided with a predetermined interval therebetween on each of said endless wrapping connectors along the length of the same so as to prevent said tubular members from contacting one another.

2. The cleaning apparatus as claimed in claim 1, wherein said at least one tank further comprises at least a first cleaning tank.

3. The cleaning apparatus as claimed in claim 2, wherein said endless wrapping connectors further comprises a drive shaft and a plurality of endless chains extended between respective driver sprockets thereof fixedly and spacedly secured on said drive shaft wherein said endless chains extend through the first cleaning tank in a direction perpendicular to the lengthwise directions of the tubular members and said driven sprokets and wherein said driver sprokets are positioned apart from said drive shaft.

4. The cleaning apparatus as claimed in claim 3, wherein said first cleaning tank further comprises an intermediate plain belt device circulatively provided between said endless chains at a midpoint thereof so as to support said tubular members.

5. The cleaning apparatus as claimed in claim 4, wherein said travelling crane further comprises at least two hooks and means for displacing said hooks upwardly and downwardly relative to said first tank between the intermediate plain belt device and respective endless chains and for turning said hooks from a direction parallel to the lengthwise direction of said first tank to a direction perpendicular to the said parallel direction of said first tank for conveying said tubular members cleaned in said first tank to a subsequent tank.

6. The cleaning apparatus as claimed in claim 5, wherein each of said hooks further comprises a serrated face along its upper edge or surface for spacedly supporting said tubular members thereon, thereby preventing said tubular members from contacting one another.

7. The cleaning apparatus as claimed in claim 2, 3 or 5, wherein said at least first tank further comprises a second, rack assembly tank including a table for supporting said tubular members which have been conveyed from the first cleaning tank by means of said travelling crane and a rack having a bar frame equipped with hook-engagement members and a pair of chuck blocks provided at opposite ends of the bar frame, said chuck blocks defining a plurality of holes for allowing said tubular members to be supportedly extend therethrough, thereby allowing said holes to be brought into registration with the corresponding tubular members and displacement of said chuck blocks toward each other so as to cause both end portions of said tubular members to extend through their corresponding holes and to thus comprise said a rack assembly in which said tubular members are spacedly supported from one another.

8. The cleaning apparatus according to claim 7, wherein at least one of the tanks further comprises a shower tank having a plurality of shower nozzles such that said tubular members assembled into said rack assembly are cleaned at both inner and outer walls thereof with said cleaning fluid.

* * * * *